United States Patent [19]

Bigarella

[11] 4,284,199

[45] Aug. 18, 1981

[54] CONTAINER WITH TEAR-OPENING ARRANGEMENT

[75] Inventor: Federico Bigarella, Segrate, Italy

[73] Assignee: Lezard S.A., Luxembourg

[21] Appl. No.: 100,999

[22] Filed: Dec. 6, 1979

[30] Foreign Application Priority Data

Mar. 15, 1979 [CH] Switzerland ..... 2446/79

[51] Int. Cl.[3] ..... B65D 1/02

[52] U.S. Cl. ..... 215/32; 220/266; 215/1 C; 222/541

[58] Field of Search ..... 220/266, 265; 215/32, 215/250, 1 C; 150/5; 222/541

[56] References Cited

U.S. PATENT DOCUMENTS

| | | | |
|---|---|---|---|
| 3,858,739 | 1/1975 | Turner et al. | 215/32 |
| 4,134,511 | 1/1979 | Deussen | 215/32 |

*Primary Examiner*—George T. Hall

*Attorney, Agent, or Firm*—McGlew and Tuttle

[57] ABSTRACT

A container with tear-opening device particularly suitable for single-dose containers, obtained by the injection of thermoplastic material in opposite molds, and consisting of a closure membrane having a particularly thin tear surface as to constitute a preferential rupture zone, having a section thermically calibrated by the shrinking (on cooling after injection). A process for obtaining said containers is also disclosed and claimed.

1 Claim, 2 Drawing Figures

CONTAINER WITH TEAR-OPENING ARRANGEMENT

FIELD AND BACKGROUND OF THE INVENTION

The present invention relates to a container with a tear opening device particularly suitable for single dose containers, obtained by the injection of thermoplastic material into apposite molds, and consisting of a closing membrane with a tear surface having a particularly thin section, as to form a preferential rupture zone, of a section thermically calibrated through shrinkage. The invention relates also to a process for the production of said containers.

The necessity of utilizing single-dose containers is present in various fields of industry: such as medicinals foodstuffs, coloring agents, cosmetics and chemical products. Such containers are indispensable when the product is degradable on contact with air and must be dispensed in small doses.

The single-dose containers presently used are equipped with closure systems which offer certain disadvantages. Above all, they have structural characteristics such that, in order to produce such containers, it is necessary to utilize dies divided in two sections, which results in a longer molding time, higher wear of the equipment and the necessity of using dies with extremely reduced tolerances, with consequent higher costs.

Moreover, some types of containers present burrs along the rupture surface, while as concerns those made of glass there is the risk that fragments of the container may end up in the product.

SUMMARY OF THE INVENTION

To eliminate these disadvantages, the present invention proposes a container with a tear-type opening device such that the surface does not present burrs and that the rupture load, in whatever direction it is applied, is minimal.

The ends of these containers are closed by means of a membrane having a very thin outline, and a much thicker central bulb which, because of the shrinkage caused by cooling, stretches the peripheral part. This bulb has a tap or stem to favor the tearing operation.

The present invention will be better understood from the following detailed description, given by way of illustration and not by limitation, with particular reference to the attached drawings.

DETAILED DESCRIPTION OF THE PREFERRED EMBODIMENTS

Figure 1:
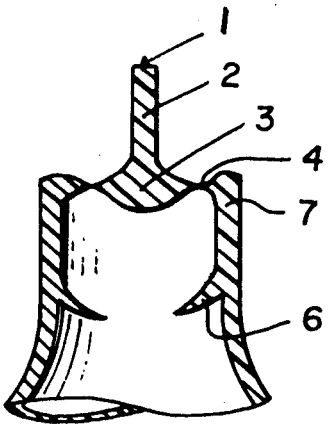
FIG. 1 represents a section of the device according to the invention.
Figure 2:
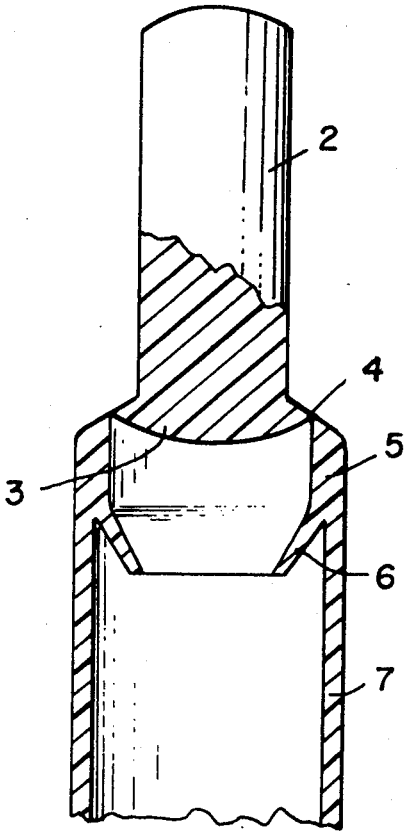
FIG. 2 represents a section of an embodiment of the device in which the riser or head which is used for the tearing may be utilized, when inverted, to reclose the container.

Referring to the drawings in particular, the invention embodied therein in FIGS. 1 and 2 shows a container having any conceivable shape terminating in a preferably cylindrical part 7.

The end of this cylindrical part is closed by a membrane 4 which thickens, proceeding toward the center thereof, to form a thicker section or bulb 3, which is also part a stem 2, which serves to effect the tearing operation.

The material forming the container, that is thermoplastic material in general and polyethylene and/or polypropylene in particular, is injected at point 1. This material forms the body of the container which has an end, preferably cylindrical, closed by a wall, one-piece with the body, with the central part 3 much thicker than the peripheral part 4.

During the cooling the shrinkage, which takes place in the bulb 3 in a higher degree than on the edge of the cylindrical part, strectches the membrane 4 which remains of a homogeneous thickness, permitting thus a rupture load constant with the change of inclination.

Inside the closure cylinder 7 there is located an annular lip 6, the thickness of which diminishes gradually proceeding from the edge toward the center of the cylinder, and which holds the liquid, preventing the free exit of same and favouring the drop-wise dosage thereof by exploiting its surface tension.

It is to be noted that, in particular cases, the container may be reclosed, for example, with the same head—now inverted—which had been removed for the opening operation, and utilizing also the internal annular lip to obtain a better seal.

The shape of the containers may vary at will, there being however preferred the conical or tronco-conical shape, to favor the utilization of entire dies, and to obtain a unit having a maximum capacity with the minimum waste of material.

One skilled in the art may then foresee several modifications or variations which, however, must all be considered as falling within the ambit of the present invention.

What is claimed is:

1. A container with a tear-opening device particularly suitable for single-dose containers, obtained by the injection of thermoplastic material into suitable molds, consisting essentially of a closure membrane having a preferential rupture section comprising a particularly thin tearing surface, wherein there is present an internal annular lip, obtained in an injection single piece, having the function of favoring the dropwise dosage of the container content.

* * * * *